US005156156A

United States Patent [19]

Ruzich

[11] Patent Number: 5,156,156

[45] Date of Patent: Oct. 20, 1992

[54] GUARD/DEPTH GAUGE FOR A CHAINSAW

[76] Inventor: Thomas J. Ruzich, 34385 Broken Oak La., Julian, Calif. 92036

[21] Appl. No.: 756,169

[22] Filed: Sep. 6, 1991

[51] Int. Cl.[5] ..... B27B 17/02

[52] U.S. Cl. ..... 30/382; 30/383

[58] Field of Search ..... 30/382, 372, 383, 151, 30/286, 289, 293

[56] References Cited

U.S. PATENT DOCUMENTS 4,063,358 12/1977 Hodge ..... 30/382 X
4,833,781 5/1989 Allen ..... 30/382 X
5,001,958 3/1991 Hall ..... 30/372 X

*Primary Examiner*—Douglas D. Watts
*Attorney, Agent, or Firm*—William H. F. Howard

[57] ABSTRACT

A chainsaw guard for enhancing safe operation of a chain saw. The guard includes a housing providing a physical barrier that limits access to the cutter chain of the chain saw. The housing has an opening for exposing a selected portion of the cutter chain for cutting a target object such as the roof of a burning building or the exterior surface of a tree. A coupler adjustably connects the housing to the chain saw. To improve flexibility, the housing includes two sections that can move relative to each other. The housing alone or in cooperation with the object being cut succeeds in enclosing substantially all of the cutter chain at all times to prevent human injury by the cutter chain, and in keeping the cutting edge facing away from the user. The housing further reduces risk of injury by limiting the depth of the cut made by the chainsaw.

13 Claims, 5 Drawing Sheets

GUARD/DEPTH GAUGE FOR A CHAINSAW

BACKGROUND OF THE INVENTION

This invention relates generally to portable hand-held power saws. More particularly, this invention relates to safety systems for preventing chainsaw injury to humans and for limiting the depth of cut of a chainsaw into a target object such as a roof or a tree.

In the field of firefighting and fire suppression in burning structures, rotary saws and chainsaws are used to cut ventilation openings. Carbide-tipped chainsaws are required for firefighting because of the wide variety of materials encountered when cutting through building structure surfaces. Ventilation openings are intentionally made by firefighters in a burning structure to reduce or remove concentrations of heat, smoke, and fire gases from a burning structure, or to channel and redirect the travel of fire.

FIG. 1 shows a typical approach for cutting a ventilation opening 20 through a roof 22 of a burning structure; only a portion of the roof of the burning structure is shown. A firefighter 24, wearing a fire-protective suit 26 including boots 28 and gloves 30, ascends to the roof. The firefighter often wears a self-contained breathing apparatus 32 including a tank 34 connected to deliver breathable air to the firefighter, for example by way of a protective face mask and hardshell helmet 36 having a face shield. The firefighter carries a chainsaw 38 for cutting the ventilation opening.

In actual practice two firefighters (only one is shown) work as a team when cutting these holes; one is the cutter (in this case, firefighter 24) and the other is the safety guide (not shown). The guide stands behind the cutter at arms length for guiding the cutter to avoid injury to the cutter and to others working close to the cutter. However, the guide firefighter is omitted from the drawing and from this discussion to simplify this explanation.

Firefighter 24, after selecting the location for cutting ventilation hole 20, starts chainsaw 38, typically driven by a two-cycle gasoline engine powerhead. To initially diagnose the roof structure and composition, the rafters and the nature of the fire, the firefighter typically makes a 45-degree inspection cut along a diagonal line 54. Building construction most often is parallel to or at 90-degrees to any exterior wall; therefore, a 45-degree cut will ensure that the chainsaw intersects a rafter 52.

A covering 48 and a base 50 of roof 22 are penetrated by this inspection cut, but underlying supporting rafters 52 are not cut. Instead, the firefighter rolls the rafter with the chainsaw—that is, the firefighter, upon feeling the rafter, lifts the saw over the rafter without cutting through it—and continues cutting for about another linear foot. The firefighter makes two additional cuts to complete a right-triangular inspection opening 46. If satisfied with the information obtained from inspection opening 46, the firefighter enlarges it along a perimeter cut 47 to make ventilation opening 20. Usually four perimeter cuts 47 are made, to define a generally rectangular opening 20. Before ventilation hole 20 is fully formed, additional cuts 56 are usually made in roof 22 parallel to rafters 52 to make the cut roof sections easier to remove with other tools (not shown).

Advantages are offered by chainsaws that significantly simplify many ventilation operations. Chainsaws are effective on roofs having a base 50 made of wood or metal. Also, chainsaws will cut heavy layers of roof composition common on older types of roof construction, and built-up layers of insulation and composition on metal deck roofs. Additionally, chain saws have excellent reach and balance which is beneficial to the firefighter-operator during cutting operations. Unlike other power tools such as rotary saws, chainsaws can be used to "feel" or "read" the construction—that is, rafters or joists—to determine their location and spacing for effectively placing cuts in roof decking.

However, chainsaws also exhibit significant safety hazards that must be considered when operating the saw. Most of the chain and cutter teeth are continuously exposed, requiring constant operational and safety attention by the chainsaw operator. Although most chain saws are equipped with a centrifugal clutch, the chain can continue to spin at idle; therefore, extreme caution by the operator is required when turning with a running chainsaw.

To avoid being injured by flying objects, the operator when cutting must strive to keep his body out of alignment with respect to the chainsaw; that is, the chainsaw operator needs to hold the chainsaw diagonally, and not perpendicularly, with respect to his body. Chainsaws often dislodge and throw objects such as nails, small rocks and splinters for a considerable distance with significant force. Eye protection must be worn by all personnel involved in cutting operations with a chainsaw. Proper positioning of the chainsaw with respect to the firefighter's body can prevent injury from a broken chain, flying debris, or kickback of the saw.

Kickback is particularly dangerous because it is so violent and it occurs so fast that the chainsaw operator cannot react quickly enough to avoid serious injury. The two common types of kickback are rotational kickback and linear kickback. Rotational kickback is the reaction which occurs when (see FIG. 1) the chainsaw cutter chain 62, at an upper chain tip portion 64 moving along the last couple of inches of the upper section of the chainsaw nose 66, suddenly stops against an object being cut. The chainsaw reacts by kicking back violently in an upwardly rotating arc, and thus back toward the head, shoulders and chest of the operator, potentially causing serious injury.

Linear kickback is a vigorous push reaction which occurs when the cutter chain is buried in a cut and then the object being cut closes around the chain, pinching it against the chainsaw underlying supporting structure so the chain stops spinning. The chainsaw reacts by kick-pushing the operator backward, possibly causing the operator to lose control of the chainsaw or lose balance to the point of falling off the roof. One technique for lessening the chance of kickback occurring is to run the saw at full throttle; however, this approach entails its own risk because, while kickback may happen less often when running at full throttle, when kickback does occur it will be even that much more violent.

Existing chainsaws are not cut-depth limited. That is, chainsaws will cut to a depth limited only by the length of the elongated chainsaw structure, shown in FIG. 1 as a guide bar 70, that supports the traveling cutter chain during chainsaw operation. The guide bar is available in lengths ranging from twelve to thirty-six inches. The most commonly used lengths measure sixteen, twenty and twenty-four inches, so the corresponding depths of cut can as a result be sixteen, twenty and twenty-four inches. To limit the depth of cut, firefighters must continuously probe and "feel" their way along, while making the cut, to determine the proper depth of cut for each cutting operation. The best "feel" is achieved when the chainsaw is held verticle, but this is an impractical and unnatural orientation. The more practical and natural way to cut is to hold chainsaws at about a forty-five degree angle with respect to the surface being cut, a surface that is usually horizontally oriented.

Therefore firefighters must "feel" their way as they cut to minimize the chance of cutting through building parts that should not be cut, such as rafters and other structural members, electrical wires and conduits, and plumbing pipes. Firefighters are forced to move slowly in a hazardous environment at a time when speed lessens their risk; firefighters must move deliberately to cut at a measured pace to feel their way along an opening they are cutting in the roof of a burning building.

A firefighter's ability to move quickly when using a chainsaw becomes more important if one considers the other factors making their work inherently hazardous. For example, roughly 70% of fires are fought between the hours of 2:00 to 5:00 A.M.; thus, a firefighter working on the roof of a burning building works with a diminished ability to see because he is literally working in the dark. Firefighters are often awakened out of their sleep and then within minutes can be fighting a fire while not yet fully awake and alert.

Contruction techniques create firefighter hazards. Modern construction methods begun roughly around 1960 produce buildings, particularly residential housing, that collapse in a fire much more quickly than buildings built before 1960. Thus firefighters must move fast for their own survival. Pre-1960 buildings structurally fail after burning for about twenty minutes. In contrast, post-1960 buildings often fail in only three to nine minutes. The on-site commander of the firefighters considers the probable type of construction method used when deciding whether or not to send firefighters onto the roof.

Construction methods before 1960 erected lumber pieces on-site and nailed these pieces together to join them; the finished structures were and are rugged. Since 1960, modern light-weight construction methods assemble lumber pieces off-site into assemblies that are then hauled to and erected at the jobsite. To form pre-built joist rafter assemblies, a an off-site assembler hydraulically squeezes metal gusset plates having one-eighth inch spikes into the lumber. On-site the builder combines these triangles-within-triangles rafter assemblies into a roof structural support system. In contrast to pre-1960 buildings, the resulting post-1960 building are less rugged and more susceptible to faster structural failure during a fire.

A fire quickly heats these metal gusset plates, which transfer their heat to burn the wood they join. Gusset plates quickly become localized hot spots that intensify the heating rate of the underlying wood. As a result the wood burns more quickly. Further, metal gusset plates expand faster than wood when heated, moving the spikes relative to the wood; this movement loosens structural joints to cause roof structural failure sooner. Studies show that failure of one gusset plate joint triangle causes at least three more to fail; like dominoes the entire roof structure falls soon thereafter, taking with it any firefighters above and below.

Firefighters wear bulky protective gear and other equipment weighing anywhere from 40 to 80 pounds; this diminishes the ability of a firefighter's body to feel how a chainsaw is responding to the material it is cutting. Further, this weight and bulkiness makes it difficult to respond to such hazards as chainsaw kickback. Fires spread quickly through burning buildings; firefighters need to cut a ventilation hole quickly and then leave.

Consequently, a need exists for chainsaw systems that are safer to operate and therefore that reduce or eliminate the hazards arising from normal chainsaw operation. In particular, firefighters need a safer chainsaw which enables them to work quickly with a chainsaw to make cuts of limited depth in a burning environment that by its nature is dangerous.

SUMMARY OF THE INVENTION

A major advantage of this invention is that it significantly improves safety of chainsaw operations. Safer chainsaw operation is particularly important to firefighters cutting with a chainsaw in the hazardous environment of a burning building. A broad concept of this invention, to achieve this and other advantages, is to enclose the hazardous cutter chain of a chainsaw in an adjustable housing. The user adjusts the housing to expose that portion of the cutter chain required to make a cut of a desired depth.

The present invention offers additional advantages. Because the housing is open at its bottom, the housing routes cuttings out through the bottom, thus reducing the chance of throwing objects cut loose by the chainsaw. The weight and balance of the housing reduces the intensity and incidence of both rotational and lateral kickback. If kickback does occur, the chance of injury is reduced because most of the cutter chain is covered and therefore unable to cut anyone. The housing is made strong to support a firefighter's weight after a cut has been made, lessening the chance of being thrown off-balance.

The depth of a cut can be set in advance, thus lessening the chance of cutting too deep into hazardous objects such as structural members, electrical conduits, pipes and nails. Because the cut depth can be pre-set before climbing onto a structure, a firefighter can move more quickly without having to "feel" his way along while making a cut for testing to roll the rafters. Training and re-training time is decreased. Without this invention, a firefighter first learning to cut with a chainsaw must invest time in training, and periodically in re-training, to develop and maintain a sense of "feeling" along the cut. However, this invention eliminates such training; the present invention pre-sets the depth of cut so all firefighters, both new and seasoned, proceed full speed ahead with each cut from the beginning.

Briefly summarized, the invention defined broadly by the appended Claims provides a chainsaw guard apparatus and method. The guard includes a housing and a coupler for connecting the housing to the chainsaw. The housing forms a physical barrier limiting access to the chainsaw cutter chain. The housing defines an opening through itself for exposing a variable and selectable cutter portion of the cutter chain as is appropriate for cutting a target object such as a roof. The coupler cooperates with the housing and the housing opening for exposing that portion of the cutter chain desired.

Other features of the invention defined by the Claims include a housing with a height H1 greater than its width W1; the housing is divided into first and second sections. One section, in this example the first section, is fixed in place to the chainsaw. The other section, in this example the second section, is mounted for sliding with respect to both the chainsaw and the first section. The housing is closed across its top to cover the cutter chain. In contrast, the housing is open through a horizontal slot along its bottom for chain cooling and for cuttings expulsion; however, to prevent human touching of the cutter chain, the housing sides extend downward below the cutter chain to thereby keep the chain recessed within the housing. The coupler penetrates the housing through a housing verticle wall slot and penetrates the chainsaw through a chain-carrying guide bar; the coupler is turned to clamp or release the housing as desired for exposing a selected portion of the cutter chain.

A depth gauge is provided for setting a desired cut depth made by a chain saw cutter chain in a target object. Example target objects include a roof of a burning building and a surface of a tree undergoing tree surgery. This depth gauge includes a housing which overlies the cutter chain and a setting device for exposing a desired cutter chain portion selected for the depth of cut preferred. Firefighters can make a fast cut holding the chainsaw at roughly a forty-five degree angle, the natural position for holding the saw when cutting.

Further, the claimed invention defines a method for controlling the cutting operation of a chain saw. The inventive method includes the steps of enclosing the cutter chain in a housing formed to expose a selected cutting portion of the cutter chain; the method also includes adjustably mounting the housing in such a manner that the housing can be moved to expose the cutting portion selected.

Additional features of the invention are defined with greater detail in the Claims. However, for an example of a specific system for implementing the claimed invention, reference is to be made to the example presented in the detailed description and figures. By studying the broadly claimed invention and the specifically described example, those skilled in this technical art will recognize other features and advantages that, although not specifically discussed here, will become apparent and therefore remain within the true scope and breadth of the invention claimed.

BRIEF DESCRIPTION OF THE FIGURES

In the figures showing the example discussed in the preferred embodiment of the invention.

DETAILED DESCRIPTION OF THE PREFERRED EMBODIMENTS

The invention is defined by the appended claims. The broad scope of the claimed invention so defined encompasses many conceivable specific example constructions. However, the content and organization of the invention, along with its other features and advantages, will be better understood from the specific example system shown in the figures and discussed in this Detailed Description.

Figure 1A:
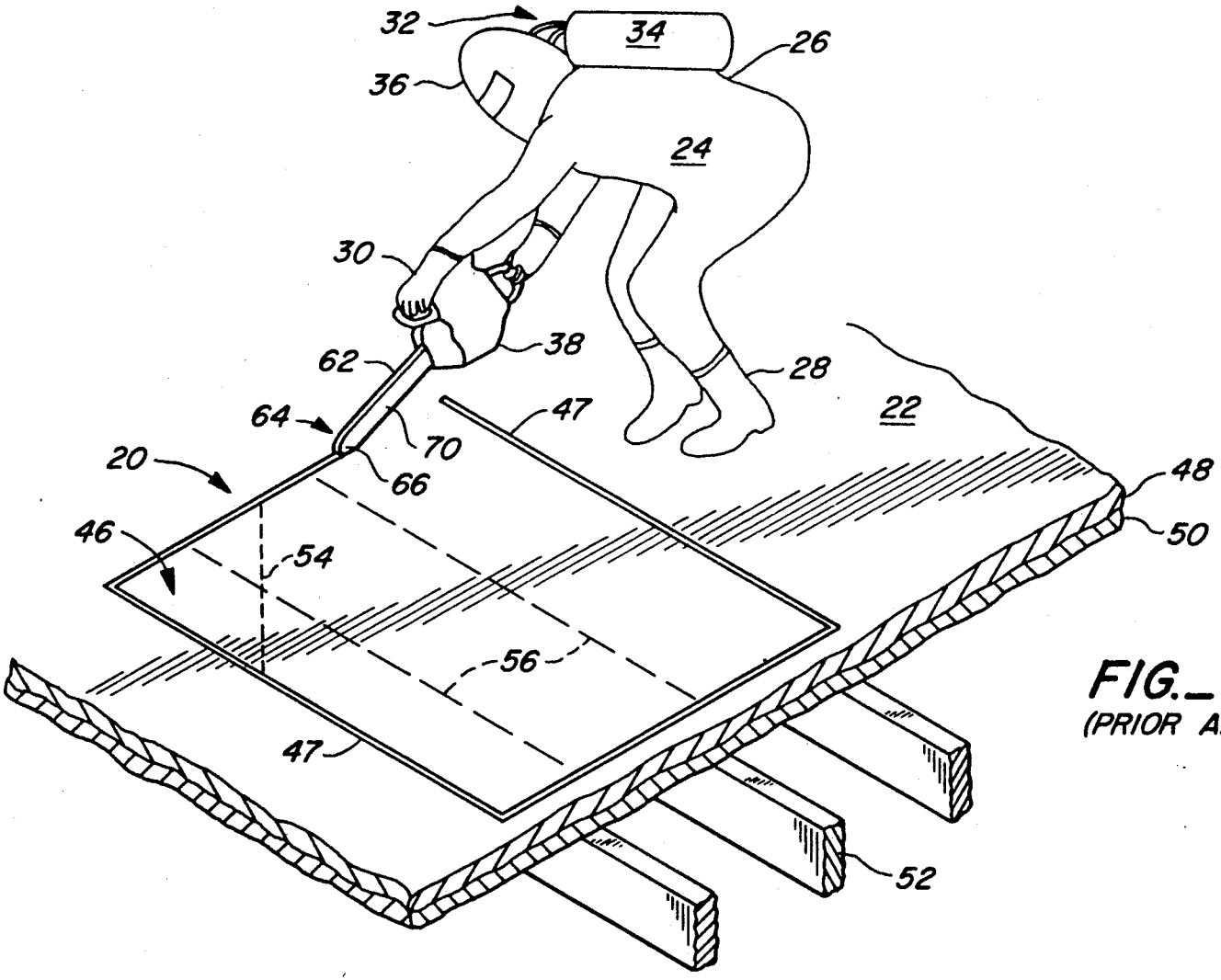
FIG. 1A (PRIOR ART)
FIG. 1A shows a conventional chainsaw in use by a firefighter when cutting a ventilation opening in a roof of a burning structure.
Figure 1B:
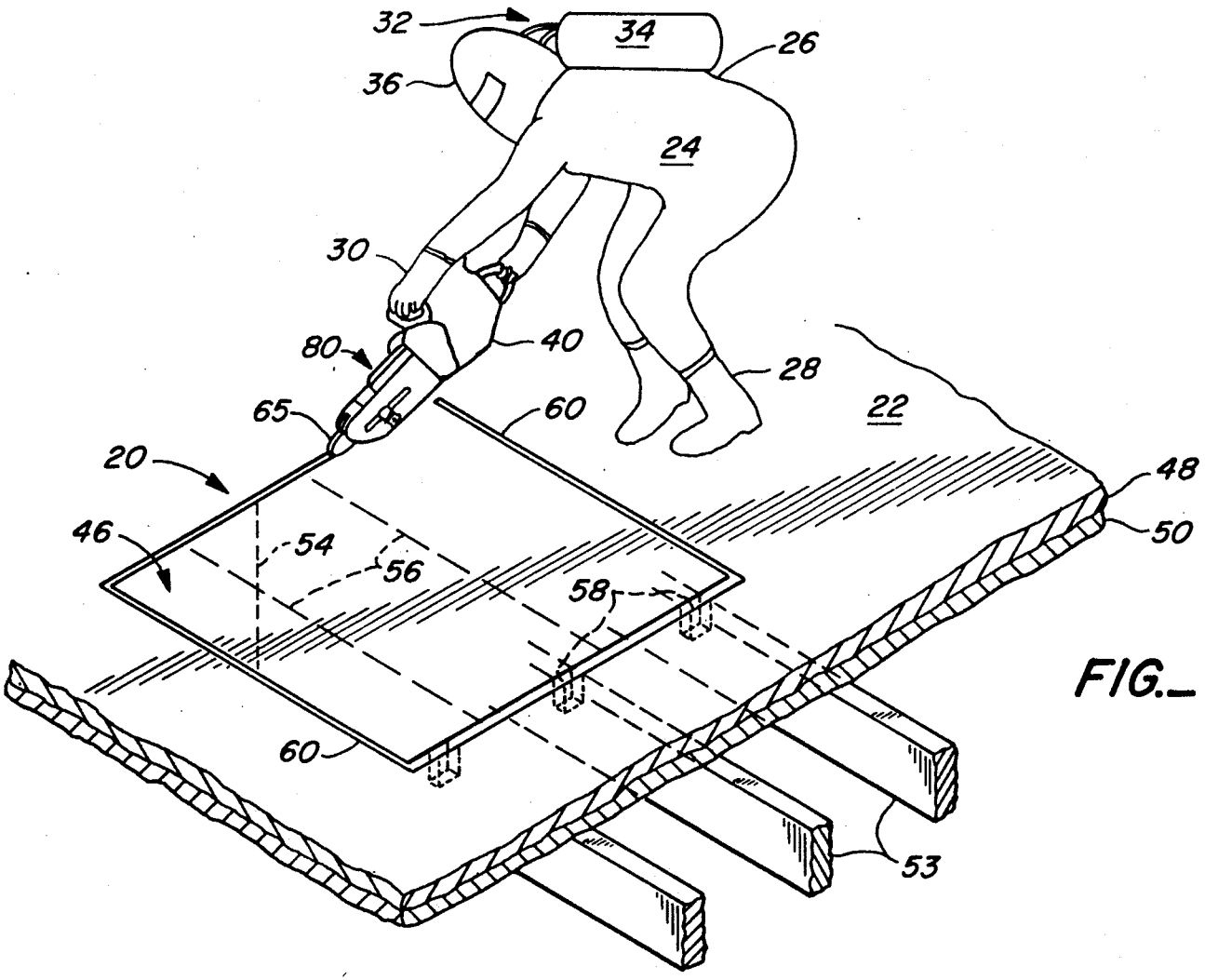
FIG. 1B is an example showing an embodiment of the invention in use on a chainsaw adapted for the invention; a firefighter is shown using the adapted chainsaw to cut a ventilation opening in a roof of a burning structure.

FIG. 1B shows an example structure of a chain guard 80, added to the environment of FIG. 1A. The major differences of FIG. 1B over FIG. 1A relate to an chain guard 80, to a modified chainsaw 40 for supporting guard 80, and to the nature of particular cuts 58 made through a top portion of rafters 53 when the firefighter is making perimeter cuts 60 to form ventilation opening 20.

Chain guard 80 is preset in advance by the firefighter to expose a desired chain tip portion 65; the chainsaw can cut only as deep as the length of the exposed chainsaw. This cut depth limitation allows for cutting at full speed ahead, allowing cuts 58 to be made through the tops portions of rafters 53 without significantly weakening them structurally. A firefighter's goal when cutting the ventillation opening is to cut the roof sheeting without cutting the underlying roof support structure, or at least without cutting that structure enough to significantly weaken it. Firefighters often score the rafters to a depth of about one-eighth to one-fourth of an inch into the rafter, a cut depth that is acceptable from a safety standpoint.

Figure 2:
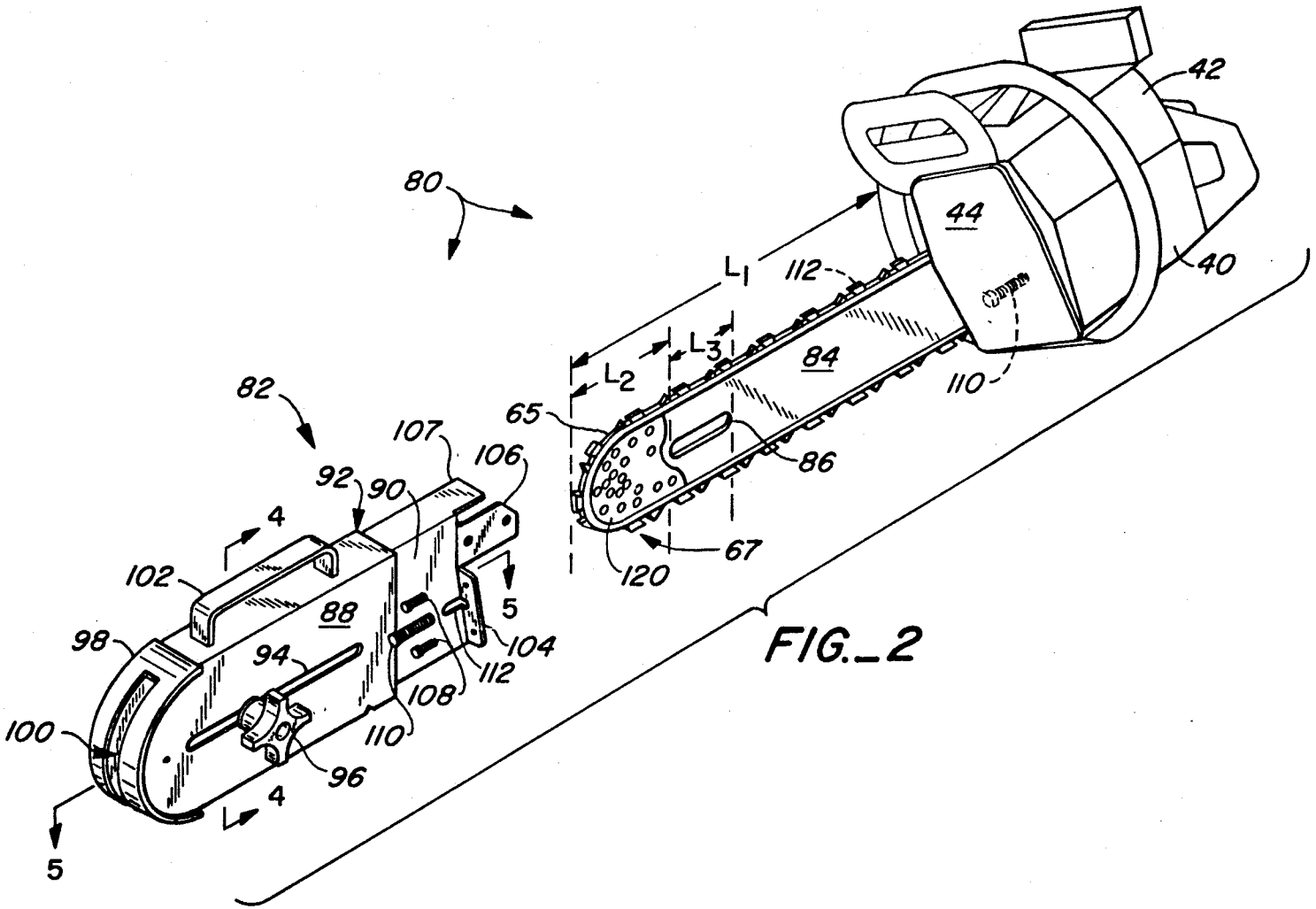
FIG. 2 is an example showing an enlarged, partially exploded, orthogonal view of the FIG. 1B adapted chainsaw.

FIG. 2 shows details of guard system 80, which includes a hollowed-out housing 82 that connects to a chainsaw guide bar 84 modified by addition of a guide bar slot 86. A pair of housing sections, front section 88 and rear section 90, join together along a translatable interface 92 to form housing 82; in the example embodiment shown, section 88 slides back and forth over the outside of section 90. A slot 94 penetrates the sidewall of section 88 for receiving a shaft (not visible) extending away from a hand-adjustable knob 96. A chainsaw user such as firefighter 24 hand-turns knob 96 to loosen or tighten it for either moving or securing housing section 88 with respect to section 90. An endplate 98 fits around the outboard end of housing section 88; a slot 100 through endplate 98 is an opening for exposing chain tip portion 65 in the length desired by the user. For this discussion, the "outboard end" is toward the free-end tip of the guide bar furthest from the powerhead, while the "inboard end" is toward the end of the guide bar attached to the powerhead.

A handle 102 is secured to the top of housing section 88 to grip the chainsaw for while setting the gauge for a desired cut depth. Chainsaw operators can also grip the handle when cutting into a verticle surface such as a wall or tree (not shown). A pair of flanges 104 and 106 extend from housing section 90 for securing housing 82 to a powerhead 42 of chainsaw 40. A third flange 107 extends backward away from the top housing section 90 and covers a top rear portion (not shown) of the cutter chain for safety. Allenhead screws 108 fit through a pair of holes in flange 104 and are secured to powerhead 42 adjacent a safety guard plate 44 mounted on front of the powerhead. A longer allenhead screw 110 fits into powerhead 42 through a slot 112 penetrating flange 104; screw 110 replaces a standard slotted tension adjustment screw already present in chainsaws.

Slot 112 is shaped to pass a tool (not shown) having a spherical allenhead wrench end that mates with screw 110 at about a forty-five degree angle. This slot arrangement is required for the screw adjustment tool to have sufficient clearance to be turned without colliding with other structures of chainsaw 40. Screw 110 when rotated moves guide bar 84 laterally for adjusting the tension on a cutter chain 112 supported by guide bar 84. Flange 106 also has holes for receiving bolts (not shown) for securing housing section 90 to the side of powerhead 42. The bolts used to secure flange 106 are already present on the side of the powerhead, so these bolts to be used are simply removed and re-inserted into their original positions.

An optional sprocket 120 riveted at a nose 67 at the outboard end of guide bar 84 includes a gear-shaped wheel (not shown) that engages cutter chain 112 and rotates with the chain as it travels rapidly around guide bar 84. The length L1 of guide bar typically comes in standard increments of sixteen, twenty and twenty-four inches. Sprocket 120 has a length L2 on the order of nine and a half inches. For this embodiment the length L3 of slot 86 is about one and one-eighth inches. Although not visible in FIG. 2, housing sections 88 and 90 are open at the bottom for expelling debris (not shown) such as sawdust and roof tar fragments cut loose by cutter chain 112. This opening also air-cools the cutter chain by allowing it to reject the friction heat generated by the chainsaw as it cuts through a target object such as wood.

Figure 3:
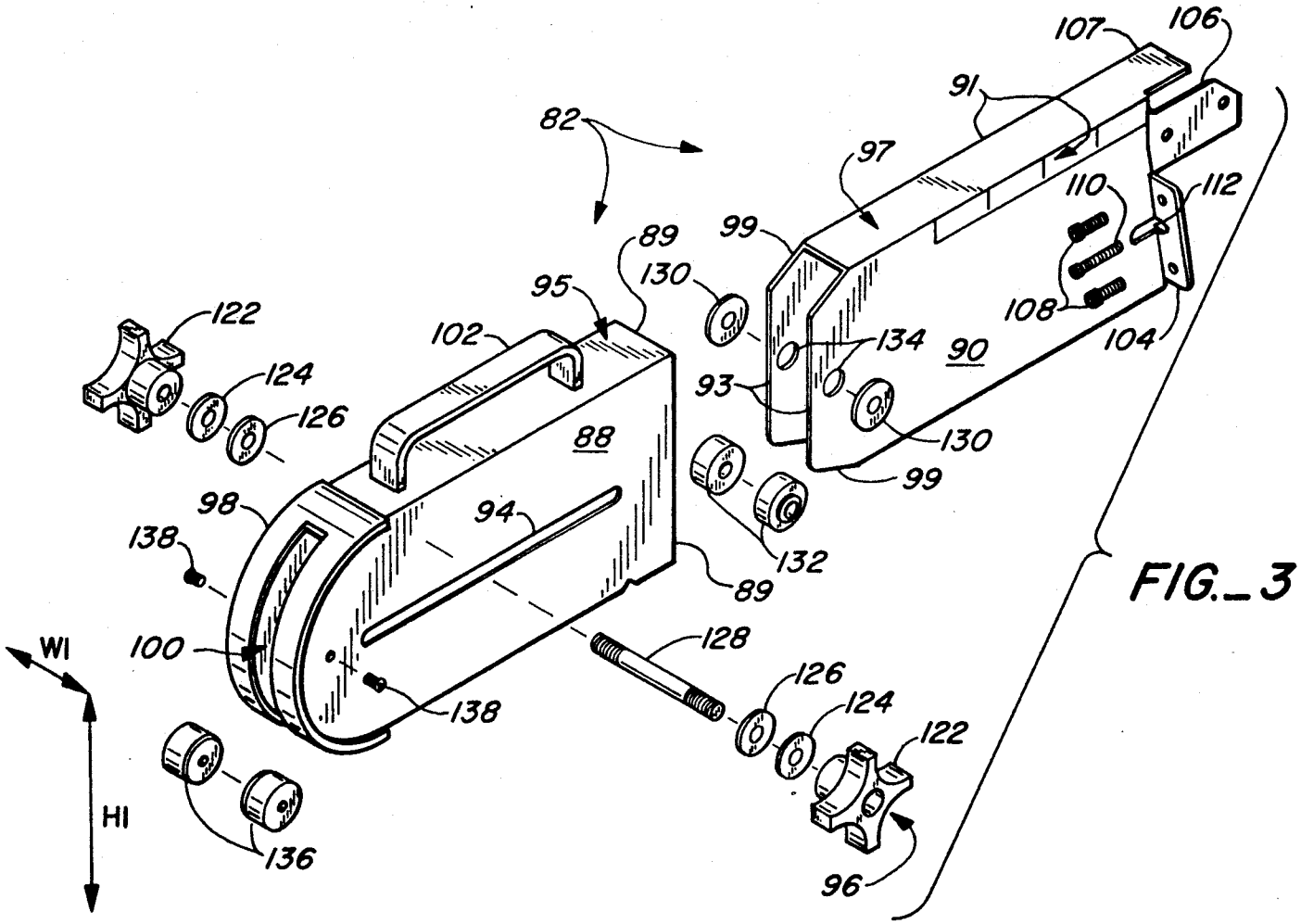
FIG. 3 is an example showing an enlarged, exploded, orthogonal view of portions of the chainsaw shown in FIG. 2.

FIG. 3 shows an enlarged, exploded view of housing 82. This housing is a rigid heavy gauge welded aluminum body strong enough to support the weight of a firefighter plus the extra forty to eighty pounds of fire protection gear and tools he carries. Top plates 95 and 97 respectively close off the tops of housing sections 88 and 90; these top plates add extra structural strength to the housing and also safely cover the underlying cutter chain (FIG. 2) to prevent injury. Tapered edges 99 at the outboard end of housing section 90 allow section 90 to fit into interior of endplate 98 as far as possible, to achieve the maximum overlap between sections 88 and 90 when slid together. Endplate 98 is curved so firefighter 24 can smoothly and easily push or pull the chainsaw along the roof surface while cutting to the desired depth.

The two outside ends of knob 96 terminate in a pair of handles 122 connected through two pairs of washers 124, 126 to a common shaft 128 penetrating slot 94. Though not visible, slot 94 appears in a mirror image on the opposite side of section 88 for admitting shaft 128. Shaft 128 also passes through a pair of washers 130 and a pair of spacers 132 positioned respectively on the outside and inside of a pair of holes 134 in housing section 90. Shaft 128 also passes through slot 86 (FIG. 2) in guide bar 84. Spacers 132 fit snugly against guide bar 84 so housing section 90 is centered and parallel to guide bar 84. Likewise, a pair of spacers 136, secured with screws 138 inside housing 88 adjacent end slot 100, fit and slide snugly against guide bar 84. In use, a firefighter hand-turns either of the handles 122 to release section 88, slides section 88 forward or backward to a desired position based of the depth of cut desired, and then hand-turns either handle 122 to once again secure section 88 in place. These handles plus the structure for joining and using them can be referred to as a coupling means.

A depth gauge 91 is defined on housing section 90 along the top edge on each of the two long sides of the section. The depth gauge has a linear scale, preferably gruadated in inches, that begins about two to four inches back from housing section 90's outboard edge 93. The scale preferably begins with the number zero, extends back about six inches to end in this preferred embodiment at the number five, where the gauge stops at about the beginning of flange 107. Depth gauge 91 is positioned for setting a cutting depth for a chainsaw held at about a forty-five degree angle, the usual angle of attack the chainsaw operator uses. Further, this calibration is made considering the inboard edge 89 of front housing section 88; the operator aligns this edge with the scale of depth gauge 91 to set the cut depth desired. For example, to set a three inch cut depth, a firefighter will align edge 89 with the three-inch marker of depth gauge 91's scale. The markers are large enough that a firefighter with normal vision can see the markers when the chainsaw is held at about arm's length away.

Figure 4:
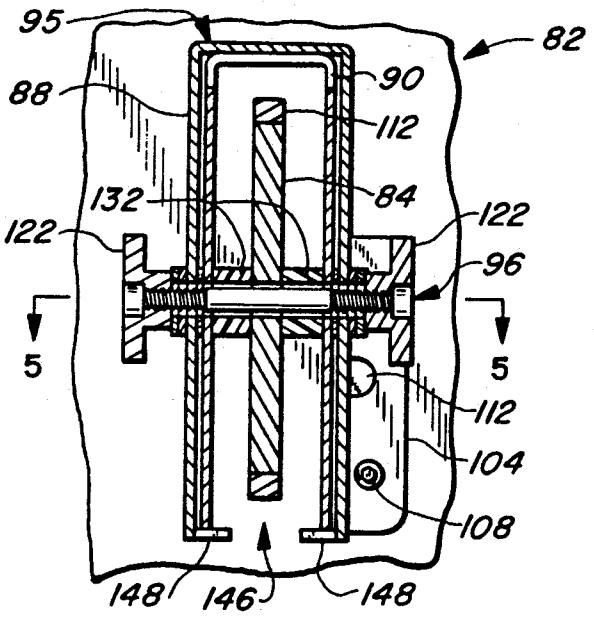
FIG. 4 is an example showing a front cutaway view taken along section 4—4 of FIG. 2.

FIG. 4 shows a cross-section of FIG. 2 taken along section 4—4. FIG. 2 illustrates the fit among housing sections 88 and 90, knob 96, and guide bar 84. FIG. 4 also shows an opening 146 through the bottom of housing 82 for expelling heat and cutting debris. A pair of tabs 148 extend horizontally inward from the bottom of housing section 88. The bottom edges of sections 88 and 90 extend downward beyond the bottom of cutter chain 112 sufficiently to provide a physical barrier against a user's accidental touching the bottom of the cutter chain. Tabs 148 continuously support a portion of the bottom edge of housing section 90, giving added structural support against downward separation of sections 88 and 90 at interface 92.

Figure 5:
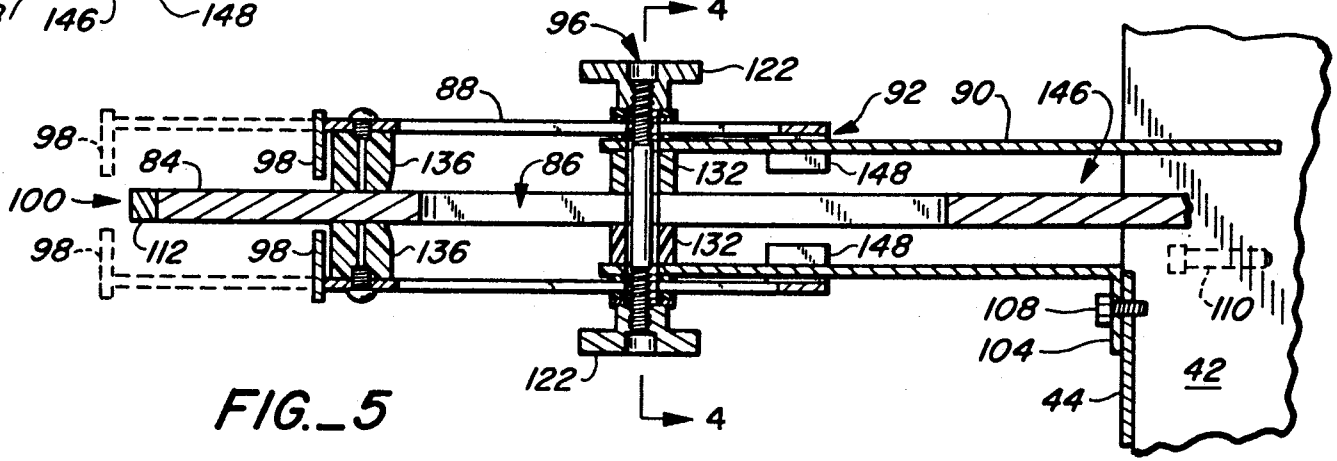
FIG. 5 is an example showing a top cutaway view taken along a section 5—5 of FIG. 2.

FIG. 5, a cross-section taken in FIG. 2 along section 5—5, shows a top view of housing sections 88 and 90 joined together by knob 96. As shown in ghost, housing section 88 can slide far enough toward the outboard end of the chainsaw for endplate 98 to extend beyond cutter chain 112. Thus extended, housing 82 completely encloses cutter chain 112 so it cannot accidently cut people.

The current production plan is that Cutters Edge, a Division of Edge Industries, Inc. of Julian, Calif., USA, will manufacture a product embodying the present invention. Present thinking is to name this product the "Cutters Edge D-8 Chain Saw Guard/Depth Gauge"; for convenience this name will be referred to by the nickname "D-8" to ease written and verbal communication. However, other plans and names are feasible, too.

Besides the above example, other hardware arrangements are possible that will remain within the scope of the invention defined by the Claims. For example, the housing can be a single unit or multiple units that are spring-loaded over the cutter chain and attached to the bar. The cutter chain can then be exposed through the housing by the firefighter either pulling or pushing against the spring-urging direction.

As noted previously, and to restate for emphasis, the foregoing example presents a discussion of a single specific example system(s) for practicing the invention broadly defined by the claims. Of the many specific systems possible for implementing the claimed invention, this particular example drawn and described above is thought by the inventors to be the best mode of practicing the invention. However, the inventors contemplate that many other specific systems with different figures for implementing the invention will become apparent to those skilled in this art. Therefore, the inventors intend the appended claims to define the invention broadly to thus include all such alternate specific systems.

The invention claimed is:

1. A safety guard for a chainsaw having a cutter chain, said guard comprising:

a housing means for forming a physical barrier that limits access to a cutter chain supported on a guide bar of a chainsaw, including a first section immovably secured to the chainsaw powerhead and a second section movably secured to said first section, said second section defining an arcuate outboard end with a nose opening through itself for exposing a variably selectable chainsaw nose cutter portion of said cutter chain for cutting a target object, said housing means further defining a bottom opening formed by extending said housing means downward beyond the bottom length of said chain to create a region for shielding said chain bottom length from making cutting contact while exposing said chain bottom length for expelling chain cuttings and heat; and a clamping means for adjustably securing said second section to said first section of said housing means, including a guide bar hole penetrating said guide bar, a housing means hole penetrating said housing means, and a connector insertable through said holes and terminated with an adjustable knob on each of two sides of said housing means hole, each of said knobs being adjustable to clamp and release said second section with respect to said first section to expose a desired chainsaw nose cutter portion for making a desired cut.

2. A guard as in claim 1 wherein said housing means comprises a first section immovably secured to the chainsaw powerhead, said first section including a first flange means for connecting said first section to a powerhead side using the fasteners that secure said guide bar to said powerhead side, and said first section further including a second flange means for connecting said first section, with attachment means, to a powerhead front facing said chainsaw and housing outboard end.

3. A guard as in claim 1 wherein said second section includes stabilizer means comprising:

tab means, formed toward an inboard lower end of said second section, for slidably engaging a lower portion of said first section, said tab means inhibiting vertical rotation of said second section with respect to said first section: and spacer means, located toward an outboard end of said second section, for slidably riding against said guide bar, said spacer means inhibiting horizontal rotation of said second section with respect to said first section.

4. A guard as in claim 1 wherein said housing means further comprises a handle, immovably coupled to said housing means second section, for gripping while selectively sliding said second section relative to said chainsaw and said first section to expose a desired chainsaw nose cutter portion for making a desired cut.

5. A guard as in claim 1 wherein said housing means further comprises:

an arcuate endplate secured across said arcuate outboard end of said second section at the region of said outboard end of said chainsaw proximate said cutter chain, said endplate formed to provide rolling support permitting said chainsaw to be freely changed among a plurality of possible cutting angles while being moved along a target surface being cut by said chainsaw, said endplate simultaneously balancing and supporting against said target surface the weight of an operator and his tools including said chainsaw.

6. A guard as in claim 1 wherein said housing means further includes a tensioning means for adjusting the tension placed on said cutter chain by said guide bar, said tensioning means comprising:

a tensioning device for longitudinally moving said guide bar to adjust said chain saw tension, accessible while said housing is mounted to said chainsaw; and said guide bar hole, formed to cooperate with said clamping means to permit penetration by said connector, said guide bar hole being sized to permit said guide bar to move longitudinally during chain tension adjustment without contacting said connector.

7. The guard of claim 4 wherein said handle comprises an inverted generally U-shaped structure, connected toward the top of said second section, defining a handle opening sized to admit a gloved hand of the chainsaw operator when moving said second section with respect to said first section.

8. A guard for a chainsaw having a cutter chain wherein said guard comprises:

a housing means for limiting access to a chainsaw cutter chain, said housing means defining through its outboard end a continuously curved nose opening for variably exposing a nose cutter portion of said cutter chain for cutting a target object, said housing means further including:

a first section immovably connectable to said chainsaw; and a second section movably connectable to said first section, said second section including said housing means nose opening and having a handle for moving said second section to expose said cutter portion through said housing means nose opening; and clamping means for adjustably securing said second section to said first section, said clamping means further comprising:

a guide bar hole defined to penetrate a cutter-chaincarrying guide bar of said chainsaw;

a housing means hole defined to penetrate said housing means; and an adjustable knob means coupled to a connector insertable through said guide bar hole and said wall hole for securing said second section at a desired position to expose a desired cutter portion of said cutter chain.

9. The guard of claim 8 wherein said chainsaw further comprises a sprocketnose guidebar.

10. The apparatus of claim 8 wherein said housing means further comprises an arcuate endplate, attached to said second section at said housing outboard end, and penetrated by said continuously curved nose opening for variably exposing said nose cutter portion.

11. The apparatus of claim 8 wherein said guard further comprises a powerhead guard plate, secured to the chainsaw powerhead, oriented with a guard surface facing said chainsaw outboard end.

12. A chainsaw safety guard, formed for supporting a combined weight of a firefighter, protective equipment, firefighting tools and said chainsaw while said firefighter cuts a ventilation hole with said chainsaw in a burning structure, said chainsaw including a powerhead for driving a cutter chain, an elongated sprocketnose guide bar supporting said cutter chain, said guide bar having an inboard end connected to said powerhead and an opposite, freely movable, arcuate outboard end establishing a chainsaw nose cutter portion, said guard comprising:

housing means for physically isolating a cutter chain traveling on a sprocketnose guide bar of a freely movable chainsaw carried by a firefighter when navigating a burning structure, said housing means including:

a first and a second section, said first section being immovably connectable to said chainsaw powerhead, and said second section being movably connectable to said first section to selectably expose a chainsaw nose cutter portion while a remainder portion of said housing means covers to leave unexposed a remaining length of said cutter chain;

an arcuate endplate, secured to said second section at an outboard end proximate to said chainsaw arcuate nose, penetrated by a nose opening for exposing a selected amount of said chainsaw nose cutter portion, and formed for providing rolling support for freely adjusting the cutting angle of said nose cutter portion; and a bottom housing structure, formed to extend downwardly beyond the bottom of said cutter chain and said guide bar, for obscuring and shielding said cutter chain from cutting, said bottom structure defining a bottom opening within which said cutter chain is recessed; and clamping means, having two adjustable knobs operable from either side of said housing means, for securing and releasing said second section with respect to said first section, operable to selectably reveal said cutter portion for cutting.

13. The apparatus of claim 12 wherein said housing means is formed to selectably completely cover said cutter chain to permit said chainsaw to be safely transported when running if desired from one cutting location to another.

* * * * *